United States Patent [19]

DiFrank et al.

[11] Patent Number: 4,662,965

[45] Date of Patent: May 5, 1987

[54] ADHERING HEAT SENSITIVE LABELS TO CONTAINERS WITH HOT MELT ADHESIVES

[75] Inventors: Frank J. DiFrank, Toledo, Ohio; Ralph J. Locke, Milford, Mich.; Thomas D. Syperski, Sylvania, Ohio

[73] Assignee: Owens-Illinois, Inc., Toledo, Ohio

[21] Appl. No.: 810,463

[22] Filed: Dec. 18, 1985

[51] Int. Cl.[4] ..... B65C 3/12

[52] U.S. Cl. ..... 156/215; 118/608; 156/264; 156/359; 156/447; 156/458; 156/521; 156/568; 156/578; 425/201; 425/204; 427/208.2; 427/428; 427/444

[58] Field of Search ..... 425/201, 204; 156/215, 156/264, 447, 458, 521, 568, 578, 359; 118/608; 427/428, 444, 208.2

[56] References Cited

U.S. PATENT DOCUMENTS

| | | | |
|---|---|---|---|
| 1,026,554 | 5/1912 | Beadle | 156/578 |
| 2,711,713 | 6/1955 | Czarnecki | 118/608 |
| 2,984,342 | 5/1961 | Smith | 156/264 |
| 3,367,822 | 2/1968 | Hoffler | 156/264 |

*Primary Examiner*—John J. Gallagher
*Attorney, Agent, or Firm*—John R. Nelson

[57] ABSTRACT

In order to apply "hot melt" adhesives to thin plastic film labels for glass containers without distorting the labels, a "hot melt" adhesive which is thixotropic is melted at 350° F. and is continuously worked to maintain its viscosity at a fairly low level while being cooled to about 110° F., at which time it is applied to the label. The label is applied to the glass bottle and the resultant labeled bottle will have the property of being able to withstand pasteurization temperatures, as well as refrigeration temperatures, without having the label separate from the bottle.

14 Claims, 4 Drawing Figures

ADHERING HEAT SENSITIVE LABELS TO CONTAINERS WITH HOT MELT ADHESIVES

BACKGROUND OF THE INVENTION

In the application of labels to articles such as glass bottles which are to be subjected to pasteurization after the label is applied, it has been necessary that the adhesive for the label be one which can withstand the pasteurization temperatures. Typical adhesives that can withstand these temperatures without failing have been termed "hot melt" adhesives and have a melting temperature in the range of 280° F. to 350° F.

Obviously, if these hot melt adhesives are to be used, the label stock must be capable of withstanding temperatures that are in the melting range of the adhesive, since the labels are normally contacted by the hot melt adhesive prior to the transfer of the label to a container. One such system could well be the application of labels to beer containers prior to their being subjected to pasteurization. In such an application, the adhesive for the label must be such that it can withstand the pasteurization and refrigeration temperatures and yet have an application temperature well below the label stock distortion and/or shrinkage temperature. Hot melt adhesives have all the desired qualities with the exception of the application temperature.

SUMMARY OF THE INVENTION

The present invention is directed to a system for applying hot melt adhesives that are capable of withstanding pasteurization temperature, as well as refrigeration, to thin plastic film labels for adhering the labels to containers such as beer bottles in which the hot melt adhesive has its temperature reduced to a temperature of about 110° F. in the handling of the adhesive from a molten supply thereof to its actual application to the label.

It is an object of the present invention to continually work a thixotropic hot melt adhesive from its melt temperature of 350° F. to its application temperature of 110° F. while maintaining it at a viscosity which will wet the container, thus effecting a good label adherence.

It is a further object of the present invention to convey a molten hot melt adhesive from a reservoir thereof to a label by a series of mechanical steps that effectively reduce the temperature of the hot melt while still maintaining a low viscosity so that it will adhere a label to a container.

Other and further objects will be apparent from the following description taken in conjunction with the annexed sheets of drawings.

DETAILED DESCRIPTION OF THE DRAWINGS

Figure 1:
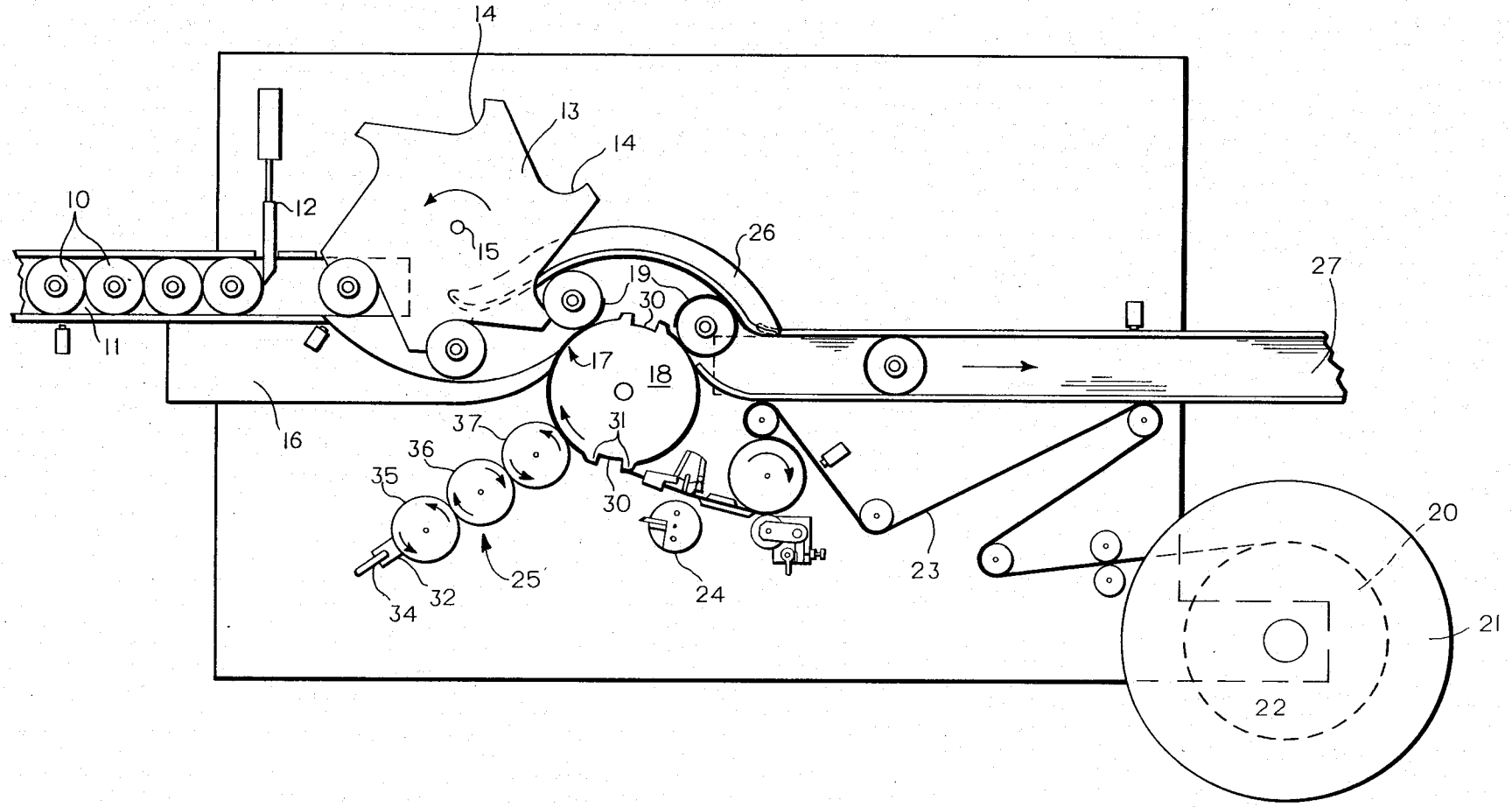
FIG. 1 is a schematic plan view of one embodiment of the apparatus of the invention.

With particular reference to FIG. 1, there is shown, in plan view, a bottle labeling system in which bottles 10 enter from the left while supported on a moving belt conveyor 11. A horizontally reciprocating gate 12 may move into and out of engagement with the containers 10 that are being moved on the conveyor 11. As shown in FIG. 1, the gate 12 is in position where it is in engagement with one of the containers to prevent pressure being applied to the container that is being engaged by a starwheel 13. While it would appear that the starwheel 13 is a single member, it should be kept in mind that the starwheel 13 normally comprises two, vertically spaced, rotatable members which are provided with pockets 14 within which the side wall of the containers 10 may be seated and that the two starwheel members will be rotated about a vertical axis 15. An upstream guide member 16, which takes the form of a generally horizontal rail having a contour which is concentric with the axis 15, holds the containers in the pockets 14 from the entry point to a point designated as 17 where the container will engage the side of a vertical vacuum drum 18. The vacuum drum 18 is adapted to hold discreet labels on its exterior surface. The labels 19 are supplied from a roll 20 carried by spool 21 which is rotatable about a vertical axis 22. The label material is unwound from the spool 21 in a continuous web 23. The web 23 is guided through a knife 24 where the web is cut into the discreet individual labels 19. The labels are picked up and adhered to the surface of the drum by vacuum. As the label is transported by the drum in a counterclockwise direction, it will have an adhesive applied to the outside exposed, surface thereof by an adhesive applying system generally designated 25 which will be described in greater detail with respect to FIG. 2. After passing the adhesive applicator 25, the label 19 will arrive at point 17 where the container, which is being guided by and moved by the starwheel 13, will engage the leading edge of the label and, due to the confinement of the container between a downstream arcuate guide 26 and the drum 18, the label will be rolled onto the container and the trailing edge of the label will be rolled to the extent that it will overlap the leading edge, thus forming a complete wraparound label for the container. The arcuate guide 26, of course, has its bottle engaging contour concentric with the outer surface of the drum and is faced with a rubberlike material to cause the bottle to engage and roll along the drum by frictional engagement therewith. The completely labeled container will exit the apparatus to the right and be guided by the arcuate guide 26 to the position where an outgoing, moving belt conveyor 27 will support the bottom of the label container and the container will be moved in the direction of the arrow shown on conveyor 27 to the right away from the labeling apparatus.

Figure 2:
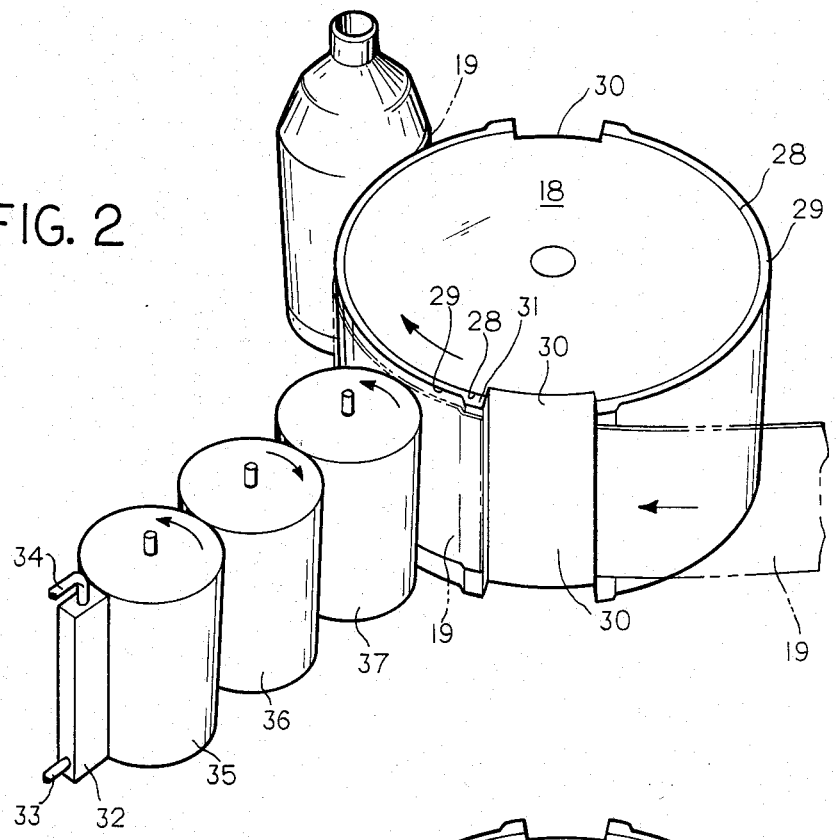
FIG. 2 is a schematic perspective view, on an enlarged scale, of the adhesive handling system of FIG. 1.

As shown in FIG. 2, the drum 18 has an exterior surface 28. The surface 28 of the drum 18 is covered with a resilient rubberlike cover 29. As specifically shown in FIG. 2, the cover is provided with raised portions adjacent a pair of opposed undercuts 30 in the drum. The raised portions are designated 31. The raised portions 31 are in pairs, one corresponding to what might be termed the leading edge of a label and the other corresponding to the trailing edge of the label. In normal operation where it is desired to provide a complete wraparound label in the manner as shown in FIG. 1, it frequently is only necessary that the label be provided with adhesive at the leading and trailing edge, with really the trailing edge being the one which is the most important, since it will be the portion of the label that overlaps the leading edge at the time of the complete wraparound of the label about the container. Such is the system that is specifically illustrated herein. However, it should be understood that a drum with a rubber or resilient covering over its outer surface, which is even and without a raised portion, is preferred when it is desired to actually adhere the entire label to the bottle or in the event a label less than a full overlapping cylinder were used, such as spot labels or labels that are less than the full circumference of the container.

As previously explained, it has become a problem in situations where it is desired to use label adhesives which will withstand shrinking temperatures and also which will withstand temperatures greater than the normal melting point of many of the adhesives. One adhesive which has been considered particularly advantageous is what has been termed as a "hot melt" adhesive which has a melting temperature in the neighborhood of 350° F. The difficulty with applying an adhesive at this temperature to a thin plastic label, in particular, such as that made by Dow Chemical Co. of Midland, Mich., under the trademark "Trycite", and even relatively thin foam plastic labels, is the fact that these labels will become distorted when exposed to 350° hot melt adhesives. To overcome this problem, the present invention provides a system wherein the adhesive, such as a hot melt adhesive, is melted at 350° F., and as shown in FIG. 2, is supplied to a vertical reservoir 32 or fountain through an inlet pipe 33 and circulated vertically upwardly and out through an overflow outlet 34. The particular system for applying an adhesive in the form of a vertical reservoir is disclosed in U.S. patent application Ser. No. 555,758, filed Nov. 28, 1983, now U.S. Pat. No. 4,574,020, issued Mar. 4, 1986. In this copending application there is disclosed a vertical, solvent containing, reservoir which is held in surface contact with a solvent applicating roll. In the case of the present application, a hot melt adhesive will be applied to a first roll or drum 35 by rotation of the drum about its vertical axis in the direction of the arrow shown thereon, past the fountain or reservoir 32. The temperature of the hot melt adhesive within the reservoir or fountain 32 will be at its melting temperature of between 280° and 350° F. and will be applied at this temperature to the first drum 35. The temperature of the first drum or roll 35 is controlled to be at about 310° plus or minus 30° F. The rotational speed of the first drum is individually controlled by means not shown. The first drum 35 is in surface engagement with a second roll or drum 36. The drum 36 is maintained at a temperature of approximately 200° F. The hot melt adhesive that is picked up on the surface of the first roll or drum 35 is transferred, and worked at the same time as it is being transferred, to the second drum or roll 36. The roll 36 in turn is in adhesive transfer relationship with a third roll or drum 37 with the drum 37 having its temperature maintained at 110° F., plus or minus 5° F. The speed of the second drum 36 may be individually controlled such that its speed is not matched with the speeds of the other drums so that the adhesive as it is being transferred from the first to the second drum and from the second to the third drum will be physically kneaded or sheared during the transfer.

Since the hot melt adhesive, such as E.P.D.M. Butyl (ethylene propylene diene M Butyl), is a thixotropic material, shearing will tend to maintain the hot melt adhesive at a viscosity approximating the viscosity at its original melting temperature of 280° to 350° so that the adhesive, when it is applied to the third drum 37, will still be at a fairly low viscosity. The drum or roll 37 is in adhesive transfer relationship with respect to the label 19 which is held by vacuum ports (not shown) on the outer resilient surface of the label transport drum 18. The drum 37 is maintained, as previously indicated, at about 110° F. which is approximately the temperature of the label transfer drum 18. The surface speed of the drum 37 is matched to the surface speed of the label 19 carried by the drum 18 such that transfer of the hot melt adhesive may be effected to the thin film label 19 without causing thermal distortion of the thin plastic film label. At the time of the transfer the actual temperature of the hot melt is significantly less than the distortion temperature which, in most instances, for thin plastic film labels would be in the order of 230° to 250° F.

The significant thing in the present system, as set forth in the operation of the apparatus illustrated in FIG. 2, is that the hot melts that melt at about 300° F., once melted, can be brought down to as low as 110° F. without significant change in viscosity. Even at the 110° F. temperature, the hot melt will still wet the surfaces and adhere to the film and to the glass or other substrate to which the film label is to be applied. Since the adhesive and the application system of the invention operate well below the thin film distortion temperature, the application of hot melt adhesive to thin film labels is simplified and the skill in operating a labeling machine is significantly reduced. While the series of drums 35, 36 and 37 are primarily an applicator of the hot melt adhesive, the interactive surfaces will cause the thixotropic property of the hot melt to maintain a wettable viscosity, even at the lower temperature at which the adhesive is applied to the thin film label.

Figure 4:
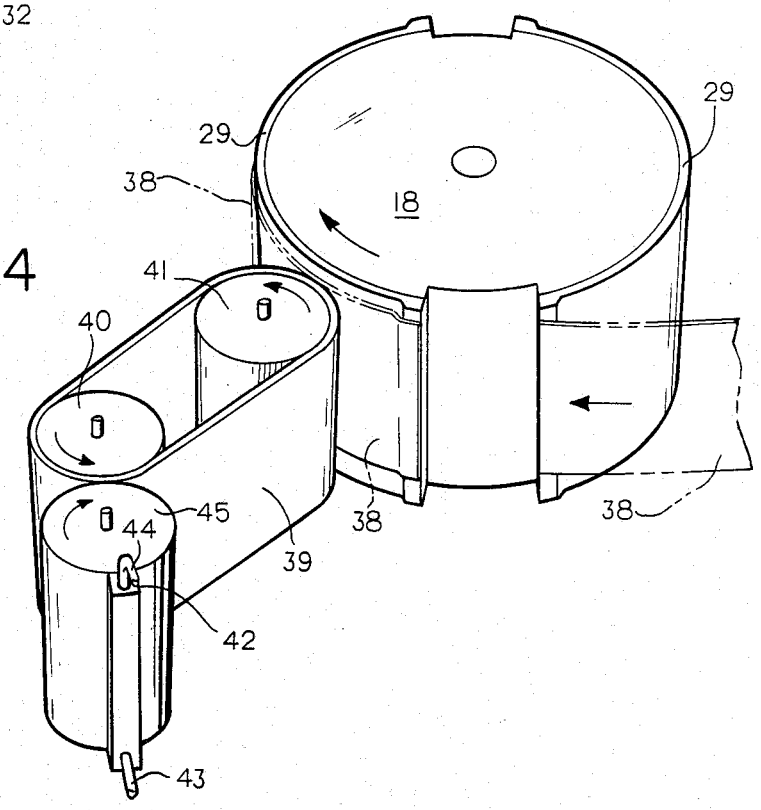
Figure 3:
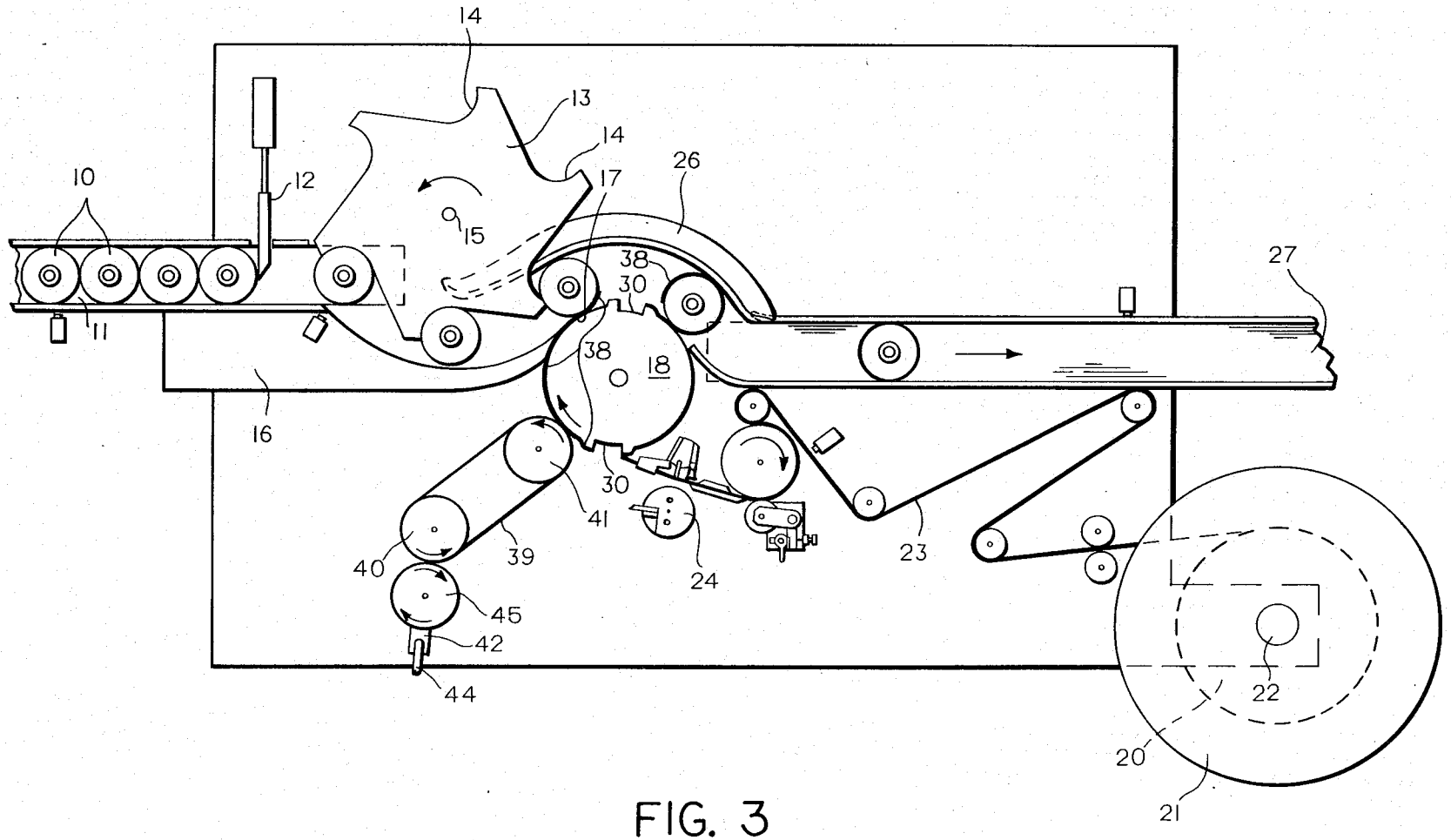
FIG. 3 is a schematic plan view of a second embodiment of the labeling apparatus of the invention; and, FIG. 4 is a schematic perspective view, on an enlarged scale, of the adhesive handling system of FIG. 3.

The second embodiment of the invention is illustrated in FIGS. 3 and 4, it being understood that FIG. 3 is essentially the same as FIG. 1 with the exception of the specific system for transferring or applying adhesive to the thin film label carried by the vacuum transfer drum, and the elements of the apparatus that are common with those in the first embodiment have been given the same reference numerals.

With particular reference to FIG. 4, the second embodiment of the adhesive applicating system will be described in detail. The label transfer or transport drum 18, rotating in the direction shown by the arrow thereon, will carry the label 38 held to its surface by the well known vacuum technique. The label 38 will be in adhesive transfer relationship with respect to the surface of a belt 39 which is supported for movement in the direction shown by the arrow thereon by a pair of supporting rollers 40 and 41. A reservoir or fountain 42 is continuously supplied with a hot melt adhesive through an inlet 43 and exits therefrom through an outlet 44 in the same manner as the fountain 32 in the first embodiment. The belt 39 may be a silicone belt capable of withstanding temperatures in the 350° range. The fountain 42 is in surface engagement or transfer relationship with respect to a drum 45. It should be recalled that the hot melt adhesive is applied to the drum 45 at its melting temperature of between 280° and 350° and the drum 45, which is at a temperature of 300° F.±20° F., is rotated in the direction of the arrow shown thereon to transfer the adhesive to the surface of the silicone belt 39. The rotational velocity of the drum 45 is such that its surface speed is different than that of the surface speed of the belt 39 so that the adhesive is being worked during transfer to maintain it at its low viscosity as it is being cooled from the 350° temperature at which it is applied to the drum 45 down to the temperature of the label. The drum 45 is maintained at a temperature of between 280° and 320° F., preferably 300° F., and the roller 40 is maintained at approximately 200° F. The roller 41 is maintained at approximately 110° F. The rollers 40 and 41 are driven at a velocity such that the surface speed of the belt 39 will match the surface speed of the vacuum drum 18 or the surface speed of the thin, plastic label carried by the drum 18. The temperature of the hot melt when it is transferred to the label 38 is such that it will be significantly less than the 250° distortion temperature of most thin film plastic label material. Thus also, the fact that the adhesive is worked and is being sheared during its transfer from the drum 45 to the belt 39, its viscosity will be maintained low enough so that it will wet the surface of the bottle to which it is transferred by the label carrying the adhesive to the bottle or other substrate. Thus, the adhesive will be applied while also still at a temperature and at a viscosity where it will wet the surface of the bottle, thus insuring its adhesion thereto.

From the foregoing, it can be seen that a system is provided for labeling empty containers such as beer bottles with labels that are capable of withstanding the temperature of pasteurization and refrigeration. Present hot melts which will survive pasteurization and refrigeration have necessarily been of the high melting temperature type thus resulting in the distortion of label stock, such as that sold by Dow Chemical Co. under the trademark of "Trycite", causing the label stock to wrinkle, distort and/or shrink at the applicating temperature of the adhesive. With the present system of applying labels with a hot melt, containers such as glass beer bottles may be prelabeled prior to their filling and then be subject to the normal pasteurization temperatures without the adhesive failing. The use of adhesives other than hot melt adhesives as a prelabeling adhesive for containers that are to be exposed to the extremes of pasteurization and refrigeration would normally result in the adhesive failing and it is with the present system of applying adhesive to thin film labels that it is possible to produce prelabeled bottles with a sufficiently adhered label that will withstand pasteurization and refrigeration temperatures that will be encountered in the processing of the filled container. While the present application is directed principally to the applying of labels to bottles where the label may be adhered completely about the circumference of the bottle, alternatively the labels might be only adhered at selected points on the labels by having the label transfer drum surface formed with raised areas which will receive the adhesive while other areas will not receive adhesive. The system of the invention of maintaining the wettability of a hot melt adhesive through the application of adhesive to the label without distorting the thin film label could be accomplished equally as well with having the total surface of the label or selected zones covered with the hot melt adhesive.

What is claimed is:

1. A method of applying a hot melt adhesive to a heat sensitive label in a bottle labeling operation wherein labels are cut from a roll and transported on the surface of a vacuum drum, rotating about a vertical axis to a label pickup area where a container or bottle is brought into contact with the label and then rolled along the drum surface to wind the label around the container, and an adhesive is applied to the label surface as it is moved by the drum from the label supply point to the label pickup area, the improvement in the adhesive applying system for permitting a hot melt adhesive at a temperature of 350° F. to be applied to a label at a temperature of about 110° F. comprising the step of working the hot melt adhesive through a series of viscous transfers while cooling the adhesive as it passes from the hot melt supply to the surface of the label.

2. The method of claim 1 wherein the step of working comprises passing the adhesive from a supply reservoir to the surface of a first transfer drum, then passing the adhesive to a second transfer drum and to a third transfer drum from the second and finally passing the adhesive from the third drum surface to the surface of the label being transported by the vacuum drum.

3. The method of claim 2 further including the steps of cooling successive transfer drums to reduce the temperature of the hot melt adhesive from 350° F. to 110° F. when applied to the label.

4. The method of claim 1 wherein the step of working the adhesive through a series of viscous transfers comprises the steps of moving a first transfer roller into surface engagement with a reservoir of molten, hot melt adhesive at a temperature of 350° F., transferring the adhesive from the first roller to the surface of an elongated, endless moving belt, transferring the adhesive from the surface of the belt to the surface of a label being carried on the vacuum drum, and reducing the temperature of the adhesive below the distortion temperature of the label stock.

5. The method of claim 4 wherein the temperature at which the adhesive is finally transferred to the labels is in the range of 110° F.–140° F.

6. The method of claim 5 wherein said label stock is a thin film label stock.

7. The method of claim 6 wherein said label stock is a thin plastic film.

8. In the method of labeling containers with thin plastic labels that are sensitive to temperatures above 250° F. by using hot melt adhesives having a melt temperature of 350° F., where the labels are cut from a web of label stock, transferred to a vacuum drum as individual labels and brought into engagement with glass containers to which they are applied by rolling the containers along the surface of the label carrying drum, the improvement comprising the steps of transferring a hot melt adhesive from a molten supply thereof to the surface of the labels and viscously working and cooling the hot melt adhesive during transfer thereof to a temperature below the distortion producing temperature of the thin plastic label to maintain the adhesive in a wettable viscosity at the lower temperature.

9. Apparatus for labeling containers using thin plastic labels with adhesives that are capable of withstanding pasteurization temperatures but do not distort the labels when applied to the labels, including a vacuum drum, means for feeding labels to the drum surface for transporting the labels from the label feeding means to a label applying area, means for applying an adhesive to at least the leading and trailing edges of said labels, means for conveying containers in an upright attitude through the label applying area where a leading edge of a label on the drum is engaged by the surface of a container, and the container is rolled along the surface of the rotating drum to wind the label on the container the improvement in, means for applying a hot melt adhesive to said label without distorting said label comprising a supply of hot melt adhesive at the melting temperature of 350°

F., a first vertical drum for receiving the hot melt adhesive from the supply, a second vertical drum in adhesive transfer relationship with said first drum, a third drum in adhesive transfer relationship with said second drum and also in adhesive transfer relationship with said label holding vacuum drum for applying adhesive to the exposed surface of the label held thereon, means for rotating said third drum and said vacuum drum at matching surface velocities and means connected to said first, second and third drums for controlling the temperatures thereof to cool the hot melt adhesive to about 110° for application to said labels.

10. The apparatus of claim 9 further including means for independently controlling the velocity of said first and second drums.

11. The apparatus of claim 9 wherein said temperature control means connected to said transfer drums controls the temperature of the first drum to about 300° F., said second drum to about 200° F. and said third drum to about 110° F.

12. The apparatus of claim 9 further including an endless belt extending around said second and third transfer drums for receiving adhesive from said first drum and transferring the adhesive to the labels on the vacuum drum.

13. The apparatus of claim 12 wherein said belt is a silicon belt.

14. The apparatus of claim 12 wherein said transfer drums are maintained at temperatures that effectively reduce the hot melt adhesive temperature from 350° F. to 110° F. while still maintaining the adhesive with a wettable viscosity.

* * * * *